US007293977B2

(12) United States Patent
Braungardt et al.

(10) Patent No.: US 7,293,977 B2
(45) Date of Patent: Nov. 13, 2007

(54) DEVICE FOR PRODUCING CONCRETE MOULDED BLOCKS

(75) Inventors: Rudolf Braungardt, Pechtelsgrün (DE); Erwin Schmucker, Schelklingen (DE)

(73) Assignee: KOBRA Formen GmbH, Lengenfeld (DE)

( * ) Notice: Subject to any disclaimer, the term of this patent is extended or adjusted under 35 U.S.C. 154(b) by 248 days.

(21) Appl. No.: 10/538,996

(22) PCT Filed: Nov. 20, 2003

(86) PCT No.: PCT/EP03/12978

§ 371 (c)(1),
(2), (4) Date: Jun. 15, 2005

(87) PCT Pub. No.: WO2004/058468

PCT Pub. Date: Jul. 15, 2004

(65) Prior Publication Data

US 2006/0124826 A1 Jun. 15, 2006

(30) Foreign Application Priority Data

Dec. 20, 2002 (DE) ..... 202 19 768 U

(51) Int. Cl.
*B28B 1/08* (2006.01)

(52) U.S. Cl. ..... 425/432; 425/169; 425/150; 425/211; 425/195

(58) Field of Classification Search ..... 425/169–171, 425/211, 150, 195, 432, 411, 414, 425, 466, 425/302.1
See application file for complete search history.

(56) References Cited

U.S. PATENT DOCUMENTS

| | | | | |
|---|---|---|---|---|
| 2,413,109 | A * | 12/1946 | Leipold et al. | 425/432 |
| 3,932,098 | A * | 1/1976 | Huber et al. | 425/412 |
| 4,729,399 | A * | 3/1988 | Wetzel et al. | 137/268 |
| 5,770,244 | A * | 6/1998 | Braungardt et al. | 425/443 |
| 5,846,576 | A * | 12/1998 | Braungardt et al. | 425/253 |
| 5,997,271 | A | 12/1999 | Taubmann et al. | |
| 6,106,264 | A * | 8/2000 | Stenekes | 425/145 |

(Continued)

FOREIGN PATENT DOCUMENTS

DE 195 08 152 * 9/1996

(Continued)

OTHER PUBLICATIONS

International Search Report.

*Primary Examiner*—Yogendra N. Gupta
*Assistant Examiner*—Dimple N. Bodawala
(74) *Attorney, Agent, or Firm*—Collard & Roe, P.C.

(57) ABSTRACT

The aim of the invention is to produce concrete moulded blocks, using a mould which is subjected to a vibrating process. Said mould comprises a frame (FR) and a moulding insert (FE) which is maintained therein. A device comprising receiving elements arranged in said moulding insert (FE) for receiving a displacement sensor (SE) is provided, in addition to an arrangement comprising said device and at least one sensor. The invention discloses advantageous embodiments and arrangements of said receiving elements. The arrangement of the sensor (SE) on the moulding insert (FE) is particularly advantageous and provides an additional displacement variable for relative displacement between the moulding insert and the frame by combining the displacement variables of a sensor (SE) on the moulding insert (FE) and a sensor (SE) on the frame (FR).

28 Claims, 6 Drawing Sheets

Figure 1:
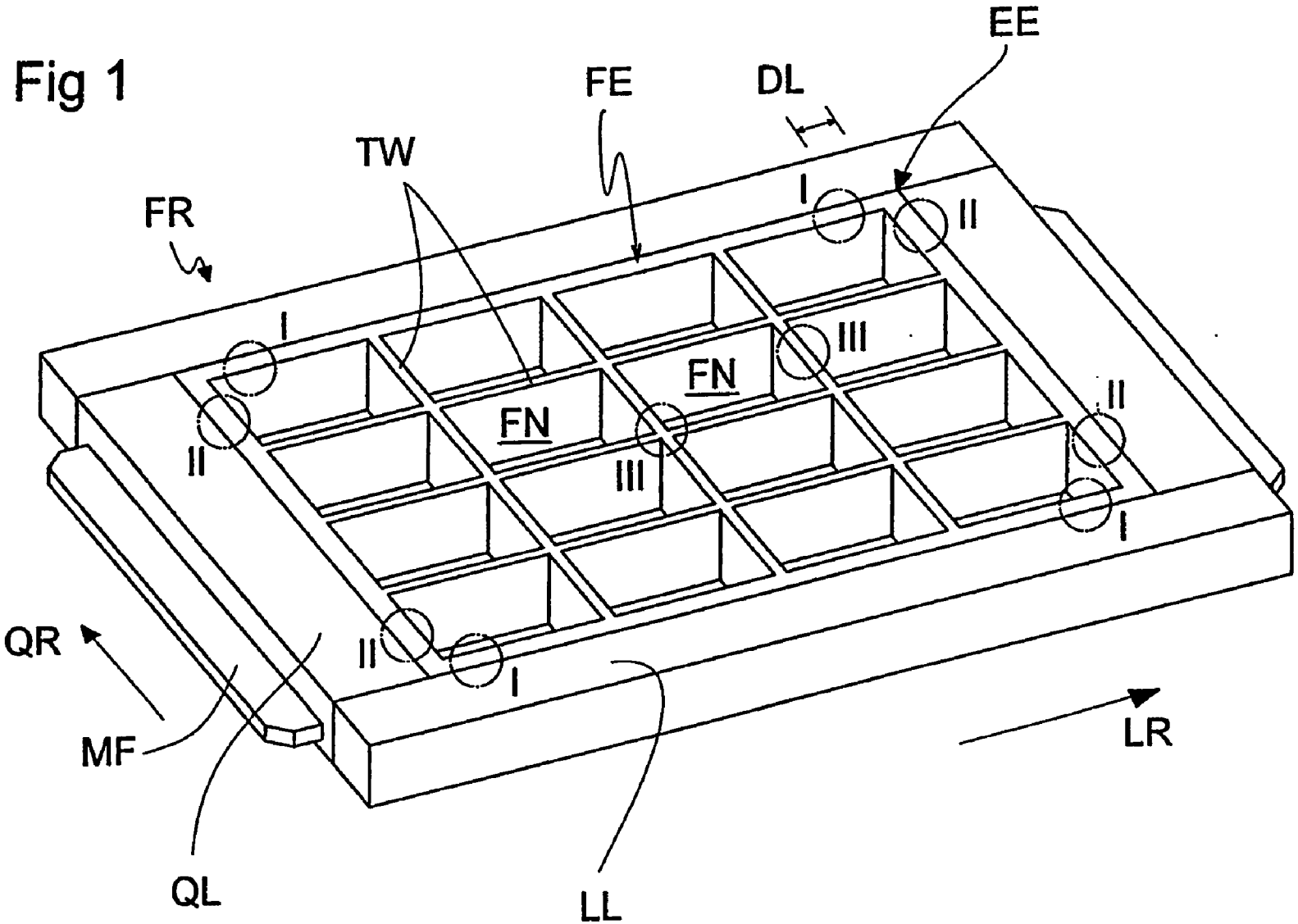

U.S. PATENT DOCUMENTS 6,342,750 B1 * 1/2002 Braungardt et al. ... 310/323.18
6,402,499 B1 * 6/2002 Braungardt et al. ..... 425/432
6,544,025 B1 * 4/2003 Steffen et al. ..... 425/150
6,843,461 B2 * 1/2005 Braungardt et al. ..... 249/63
6,849,211 B2 * 2/2005 Jarvinen et al. ..... 264/33
7,004,442 B2 * 2/2006 Braungardt et al. ..... 249/139
7,172,404 B2 * 2/2007 Braungardt et al. ..... 425/444

FOREIGN PATENT DOCUMENTS

DE 199 21 145 * 11/2000
DE 199 56 961 5/2001
JP 11 128835 * 5/1999

* cited by examiner

DEVICE FOR PRODUCING CONCRETE MOULDED BLOCKS

CROSS REFERENCE TO RELATED APPLICATIONS

Applicants claim priority under 35 U.S.C. 119 of German Application No. 202 19 768.9 filed on Dec. 20, 2002. Applicants also claim priority under 35 U.S.C. 365 of PCT/EP2003/012978 filed on Nov. 20, 2003. The international application under PCT article 21(2) was not published in English.

The invention relates to a device for producing concrete molded blocks.

The production of concrete molded blocks typically takes place in molding machines in which a molding insert having one or more mold cavities is held by way of a mold frame and, after the mold cavities are filled with concrete mass, is pressed onto a vibrating base during a vibration process.

From DE 199 56 961 A1, it is known, in the case of such devices, to measure movement variables at suitable locations, for example table, mold, and load, and to analyze them spectrally. Aside from a visual representation of the spectra, control signals for follow-up regulation of machine parameters can also be derived from deviations of the measured values from reference values. Such a regulation is also already known from DE 199 21 145 A1, where piezoelectronics, for example, can serve both as an actor in the vibration movement and as a sensor for recording movement data.

The invention is based on the task of indicating an advantageous device for producing concrete molded blocks, an arrangement having such a device, and a sensor as well as a method for determining a reference characteristic value.

Solutions according to the invention are described in the independent claims. The dependent claims contain advantageous embodiments and further developments of the invention.

The preparation of an accommodation for a sensor in the molding insert of a mold divided into a mold frame and a molding insert that is preferably releasable from the latter advantageously allows the positioning of one or preferably several distributed sensors, coordinated with the individual molding insert. As compared with the placement of the sensor at an easily accessible location of the mold frame as indicated in DE 199 56 961 A1, it is true that the solution according to the invention involves additional effort, but it surprisingly allows a significantly better assessment of the state of a mold and its behavior in the molding machine. In this connection, the accommodation is understood to mean the space for the sensor as well as the devices for connecting it with the molding insert.

By means of the accommodation for the sensor, already prepared by the manufacturer of the molding insert, the accommodation can be disposed at an optimized position, for example with regard to the informational value of the measurement values, and/or with regard to the stability of the molding insert. The insertion and destruction-free removal of the sensor into and out of the accommodation, respectively, preferably by way of a screw connection, particularly a threaded bore in the accommodation, allows the user of the molding insert to use his/her own measuring system and/or to use the same sensors for several different inserts, if applicable also those from different manufacturers and/or to measure movement variables at other positions of the molding machine. In another advantageous manner, the sensor can also be glued onto a surface of the molding insert that belongs to the accommodation, directly or with the interposition of a connection plate, particularly a connection plate having a threaded bore or a threaded pin.

The accommodation for the sensor advantageously includes a recess between surfaces of molding insert and mold frame that face one another, which otherwise are typically configured to lie closely against one another. Preferably, the recess is limited on at least four sides, in the main direction of an orthogonal coordinate system, by surfaces of molding insert and mold frame. Embodiments in which the recess is open towards the side and/or towards the bottom are preferred. The dimensions of such a recess advantageously amount to at least 10 mm in all directions, between opposite delimiting surfaces.

Preferably, damping means, particularly rubber-elastic damping plates, are inserted between molding insert and mold frame, in known manner. The damping means are particularly advantageous between surfaces of molding insert and molding frame that stand opposite one another at a distance, e.g. in the form of projections and depressions on mold frame and molding insert, known from DE 195 08 152 A1.

Preferably, several sensor accommodations are disposed distributed in a plane that lies parallel to the contact plane of the molding insert on the vibration base. In particular, several accommodations can advantageously be provided in the edge region of the molding insert, or close to its lateral outside wall. In this connection, positions of the accommodations that lie at a corner of the molding insert or are offset from a corner, along a lateral surface, by a distance that amounts to maximally 100 mm, particularly maximally 50 mm, are preferred.

According to an advantageous embodiment, several accommodations are disposed along the circumference of the molding insert, in its edge region, in a symmetrical distribution, particularly a double mirror symmetry distribution. If the structure of the molding insert permits this, at least one sensor accommodation can advantageously be provided at a distance from the edge of the molding insert, particularly in the region of its center and/or between two adjacent mold cavities.

An advantageous embodiment of a sensor accommodation provides that it contains a projection that projects horizontally from an outside wall of the molding insert, which projection is configured for attachment of a sensor element to it, particularly for a screw connection. The projection can be configured as a continuation of the outside wall of the molding insert, or can be attached to the outside wall, particularly welded to it. In another embodiment of the sensor accommodation, it can include a hole through the wall of the mold frame that faces the molding insert, particularly at a corner of the molding insert, particularly if the mold frame is configured with a wall configured as a plate or piece of sheet metal.

Preferably, the molding insert is held in the mold frame in such a manner that a slight relative movement is possible during the vibration process, particularly by means of insertion of elastic elements between mold frame and molding insert. Advantageously, at least one movement sensor can additionally be affixed to the molding frame, and the evaluation device can be set up to determine relative movements between mold frame and molding insert, for example by means of forming the difference between different sensor signals.

Figure 2:
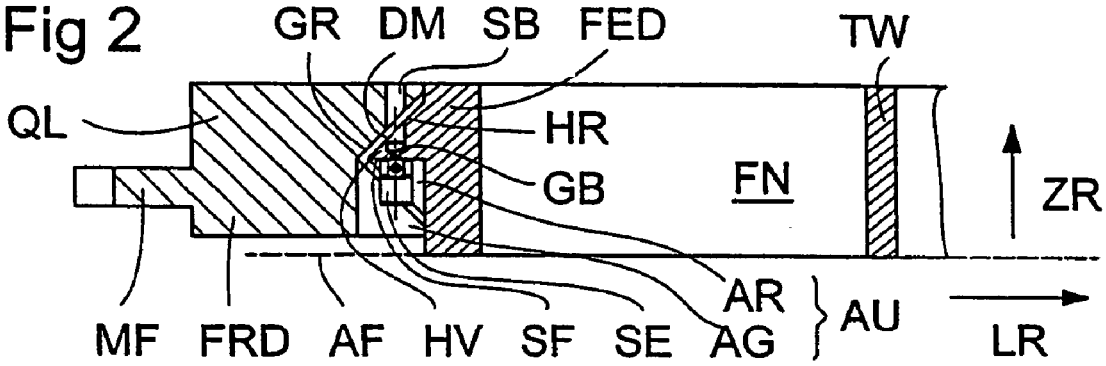
Figure 3:
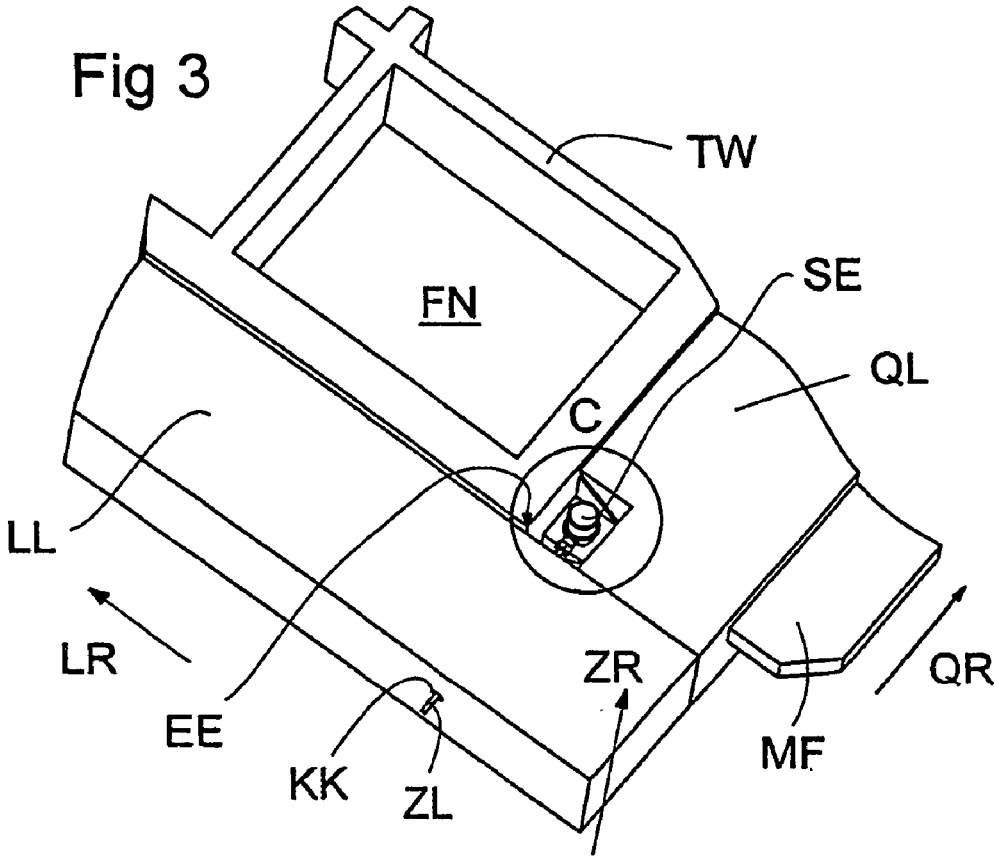
Figure 4:
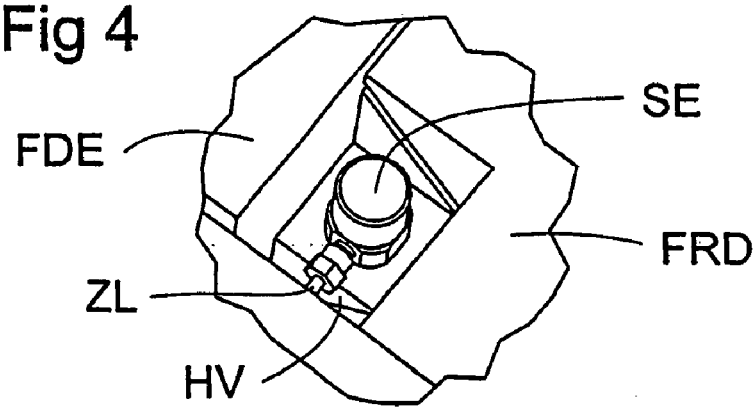
Figure 5:
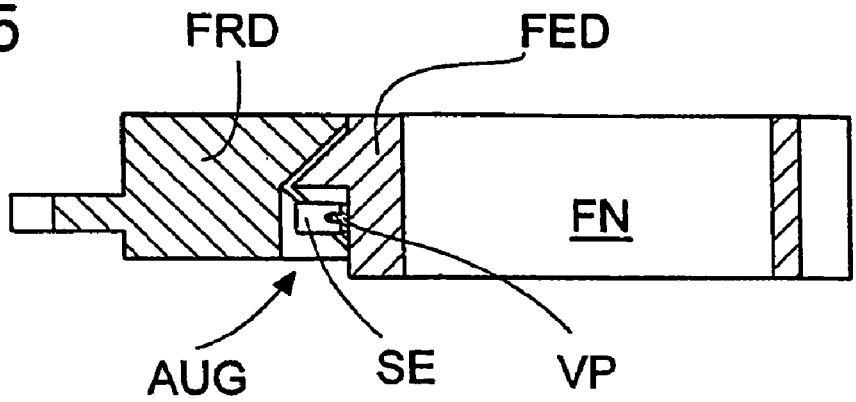

The invention is explained in detail below, on the basis of preferred exemplary embodiments, making reference to the drawings. These show:

FIG. 1 preferred sensor positions in a molding insert in a top view,

FIG. 2 a sectional diagram of a first embodiment of a sensor accommodation,

FIG. 3 the embodiment according to FIG. 2 in a slanted view from below,

FIG. 4 an enlarged detail of FIG. 3,

FIG. 5 an embodiment analogous to FIG. 2, with a different sensor orientation, FIG. 6 a slanted view from below, of the embodiment according to FIG. 5, FIG. 7 an enlarged detail of FIG. 6, FIG. 8 a sectional diagram of another advantageous embodiment, FIG. 9 a slanted view of the embodiment according to FIG. 8, FIG. 10 an enlarged detail of FIG. 9, FIG. 11 an embodiment of an accommodation in Position III according to FIG. 1, FIG. 12 a slanted view of the embodiment according to FIG. 11, FIG. 13 another embodiment of an accommodation between two adjacent mold cavities.

FIG. 1 schematically shows a device having a molding insert FE having an essentially rectangular outline and a mold frame FR that surrounds the molding insert all around, with longitudinal strips LL in the longitudinal direction LR, and transverse strips QL in the transverse direction QR. Longitudinal strips and transverse strips of the mold frame can be structured as a one-piece mold frame, or can be connected with one another as a constructed mold frame, particularly welded or screwed together. Flange strips MF that point outward are attached to the transverse strips QL, and the molding insert is held in the molding machine, moved, and particularly pressed onto a vibration base during a vibration process by means of the former. The structure of the mold frame in detail is of secondary importance for the present invention, and various embodiments known to a person skilled in the art can be used. In particular, the mold frame can also be presented merely by two transverse strips, without any connecting longitudinal strips.

For the releasable connection between the mold frame and the molding insert, particularly a non-welded connection, a large number of various embodiments is known, which can be used for the present invention, unless there are restrictions in an individual case of special embodiments of sensor accommodations.

The molding insert is typically a one-piece mold block having an essentially rectangular progression of the outside wall, in a top view, and having a plurality of mold cavities FN separated by means of vertical partitions TW. Special molds that deviate from this are known.

The embodiments of mold frame, molding insert, and their releasable connection, which are known, can be present in various combinations. The following exemplary embodiments are to be understood merely as a selection from among the possible and known variants.

It is essential to the present invention that accommodations are prepared for sensor elements for determining movement variables, preferably acceleration sensors. Sensors can advantageously be attached in the accommodations in releasable manner, preferably by means of a screw connection and/or a glue connection. By means of the prepared accommodations, the customer or service technician of the machine manufacturer, or, in particular, also the manufacturer of the molding insert and, if applicable, of the mold frame, can undertake an adjustment of the machine and/or an inspection of the molding insert, on site and while the concrete block production is in operation, in simple manner. The molding inserts are typically delivered with prepared sensor accommodations, but without sensors, but they can also be fitted with sensors. The sensor accommodations provided on the molding insert, according to the invention, are particularly advantageous in the case of arrangements in which the molding insert can be dynamically deflected, within the mold frame, relative to the latter, to a slight extent, out of a rest position, particularly during the vibration process. Preferably, elastic, particularly rubber-elastic damping means are inserted between mold frame and molding insert for this purpose.

FIG. 1 schematically shows preferred positions of the sensor accommodations provided on the molding insert according to the invention. A first group of such positions, identified as I, is provided in the region of the outside wall of the molding insert, on the longitudinal sides. Advantageously, at least two sensor accommodations are provided, at positions that lie symmetrically on a center plane that lies parallel to the longitudinal direction LR or to the transverse direction QR, preferably four accommodations at positions that lie symmetrical to both center planes, spatially distributed. In the vertical direction, i.e. perpendicular to the plane of the drawing of FIG. 1, the accommodations of such a group preferably all lie in one plane.

The horizontal distances DL of the sensor positions from the corners EE of the molding insert in the longitudinal direction LR advantageously amount to maximally 100 mm, particularly maximally 50 mm.

Another, second group of positions for sensor accommodations, identified as II, is provided in the region of the outside wall of the molding insert, on the transverse sides. Particularly advantageous embodiments can be provided here, in a manner analogous to the first group of positions I. Reference is made to the explanations regarding positions I, in this regard.

The first group of positions I and the second group of positions II are typically prepared alternatively, i.e. fitted with sensor accommodations. However, sensor accommodations can also be provided both at positions I and at positions II, on one and the same molding insert. Alternatively or in addition, sensor accommodations can also be configured at other positions in the region of the outside wall, particularly in the centers of the sides. However, positions close to a corner are preferred. Sensor accommodations of one group are preferably disposed within a horizontal plane, i.e. at the same distance from the lower contact plane of the molding insert.

Aside from positions in the region of the outside wall of the molding insert, sensor accommodations can also be provided within the enclosed field between adjacent mold cavities, which are indicated as positions III, as an example, in FIG. 1, whereby a position in the intersection of the center plane that lies parallel to LR and QR, i.e. in the center point of the diagonal of the molding insert, is preferred. In the case of such sensor accommodations that lie in the interior, a guide channel that leads from the sensor accommodation to the outside wall of the molding insert, e.g. in the form of double-shell partitions, is advantageously provided. In this connection, the guide channel can be prepared for introduction of an electrical connecting line, if necessary, but can also permanently contain such a connecting line between a connector on the accommodation side and a connector on the outside wall side.

FIG. 2 shows a sensor accommodation in the horizontal viewing direction along a longitudinal side or, in particular, a transverse side, in the case of a particularly advantageously releasable connection between a molding insert FED and a mold frame FRD. A slanted view from below onto FIG. 2 is shown in FIG. 3. In the advantageous connection between molding insert and mold frame, a relief structure HR in the form of a projection that is directed horizontally away from the mold cavities FN is configured over at least part of the length of the side wall, on the outside wall of the molding insert FED. The projection forms a horizontal profile along the outside wall. The relief particularly has a contact surface that points upward, preferably tilted at a slant relative to the horizontal, which stands opposite a parallel counter-surface of a counter-relief GR in the mold frame FRD that points downward. The counter-relief forms a depression in the mold frame, which can run back towards the molding insert below the counter-surface. The projection HR is approximately triangular in cross-section in the example shown, and the counter-relief follows this contour in the form of a depression in the mold frame that is also approximately triangular in cross-section. Damping means DM, preferably made of elastic, particularly rubber-elastic material, can be inserted between opposite surfaces of projection and depression. The molding insert FED projects downward beyond the mold frame and can be pressed onto the contact surface AF of a vibration plate or the like by means of the mold frame.

A retaining projection HV, which is preferably part of the retaining profile HR, and can particularly be configured at a longitudinal end of this profile, also projects from the outside wall of the molding insert into the depression of the mold frame, but does not fill it. The retaining projection contains a sensor contact surface SF, which preferably points downward, and an accommodation bore GB, which can also be a threaded bore, for releasably attaching a sensor element SE in a rigid mechanical connection with the molding insert. The retaining projection HV is produced, in the example shown, by means of a recess AR on the profile HR at an end of this profile, from the latter, which end faces a corner EE. The retaining profile HV can also be configured separated from the profile HR.

If the counter-relief GR in the mold frame FRD runs back towards the outside wall of the molding insert, as in the example shown, below the retaining projection, in a horizontal overlap with the latter, a recess AG can advantageously be provided in the mold frame in this lower region of the mold frame, below the retaining projection HV, which recess offers space for the housing of the sensor element attached to the molding insert, and/or for an electrical connecting cable between sensor and measurement device or evaluation device.

The accommodation for the sensor element SE includes, in the example shown in FIG. 2 to FIG. 4, not only the accommodation bore GB but also the recess AR on the insert side and the recess AG on the frame side, which together form a recess AU between mold frame and molding insert. The recess AU is delimited, in an orthogonal coordinate system, particularly having axes in the longitudinal direction LR, transverse direction QR, and in the normal direction ZR of the contact surface AF, in five main directions, by surfaces of the molding insert FED and of the mold frame FRD, whereby the dimensions of the accommodation AU between two opposite delimiting surfaces is at least 10 mm in all directions, horizontally in the example. In the example shown, the recess AU is delimited towards the top by the sensor contact surface of the projection HV, and is open towards the bottom. An electrical supply line ZL to the sensor element SE can be passed towards the outside, to an evaluation device, not shown, for example below the mold frame. The supply line can also advantageously be passed through a cable channel KK of the mold frame, as shown, which can also be configured to be open towards the bottom, in the form of a groove, in deviation from the drawing. A bore SB is advantageously also provided in the counter-relief GR of the mold frame FRD, as an extension of the accommodation bore GB, and a screw, nut, or the like can be inserted and tightened through the former, to attach the sensor element, without any need to release the molding insert and the mold frame from one another.

Figure 6:
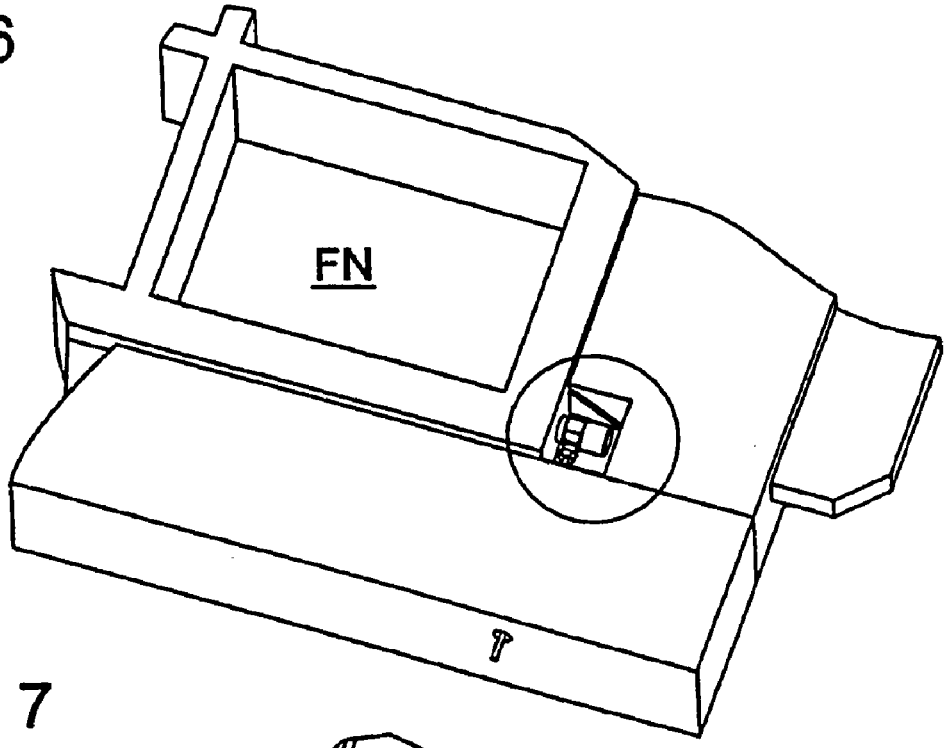
Figure 7:
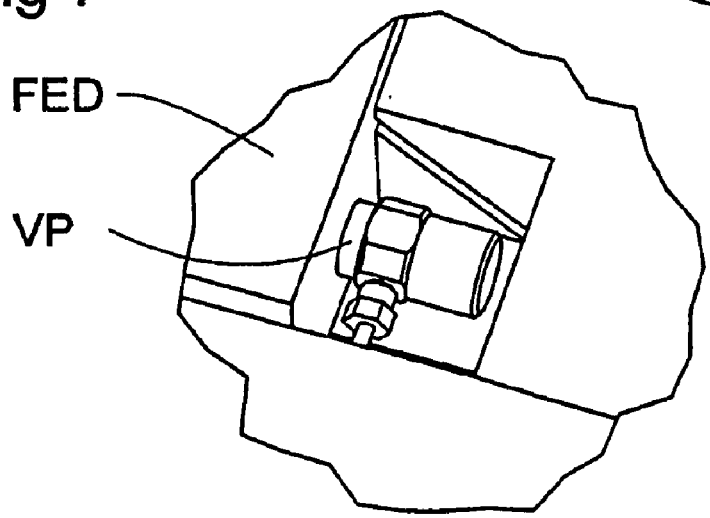

In FIG. 5 to FIG. 7, a variant is shown, in views analogous to FIG. 2 to FIG. 4, which essentially differs from the embodiment according to FIG. 2 to FIG. 4 by means of a different attachment of the sensor element on the molding insert FED, and for the remainder has taken over the structural characteristics of the embodiment according to FIG. 2 to FIG. 4, to a great extent. Here, the sensor element SE is inserted rotated by 90° as compared with FIG. 2, and attached to a vertical surface of the molding insert, whereby an embodiment for the attachment is selected here in which a connecting plate VP is attached to the surface of the molding insert, particularly glued on, and bears a threaded pin, onto which the sensor element is screwed. The orientation, rotated by 90°, allows the determining of another direction component of the movement of the molding insert, particularly in the case of the preferred sensor elements having a one-dimensional detection of movement.

Figure 8:
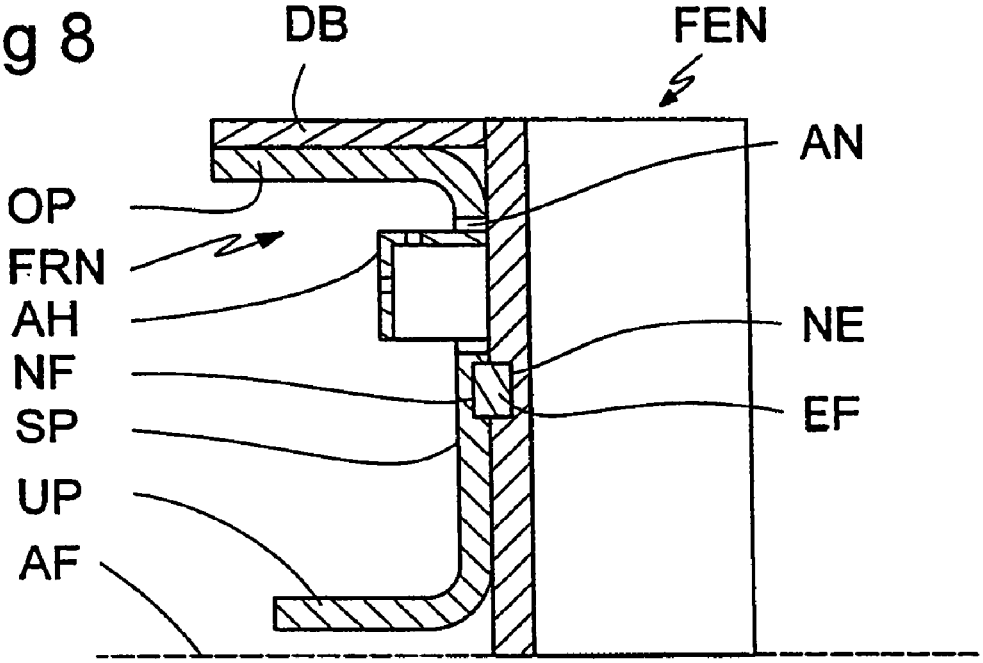

FIG. 8 shows a side view of a detail of a side wall of a mold frame FRN, beyond which a molding insert FEN projects downward, and rests on the contact surface AF of a vibration table or the like. FIG. 9 shows a view of FIG. 8 at a slant from below, FIG. 10 shows an enlarged detail of FIG. 9. The mold frame can contain, for example, a horizontal upper plate OP and a vertical side plate SP, which can be welded to one another, for example, or, as shown, structured in one piece as a bent plate and, in the example shown, can also be complemented by a horizontal lower plate segment UP. In addition, a cover plate DB is attached to the mold frame, in usual manner.

An opening AN is provided in the side wall. A retaining projection rigidly connected with the outside wall of the molding insert FEN, for example in the form of a retaining body AH welded to the outside wall of the molding insert FEN, as shown here, which is configured as a hollow body open downward, and has both horizontal and vertical contact surfaces for attaching a sensor element in different orientations, projects through this opening. The shape of the hollow body is inherently rigid, in particular, so that the sensor element reliably detects the movement behavior of the molding insert. In a simpler embodiment, the retaining body can also be structured as a bracket or plate projecting from the outside wall surface of the molding insert FEN. The attachment of a sensor element can take place within or outside of the hollow body, e.g. by means of a screw connection or a glue connection. The retaining body can also be configured in the manner of the connecting plate VP according to FIG. 5. The opening AN in the side wall SP of the mold frame FRN can also be structured to be open downward, in the form of a cut into the lower edge of the side wall plate, particularly if the mold frame is structured without a lower plate.

Figure 9:
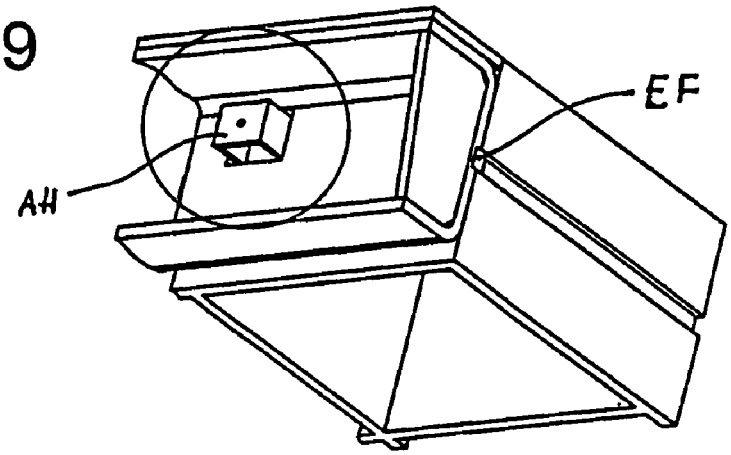
Figure 10:
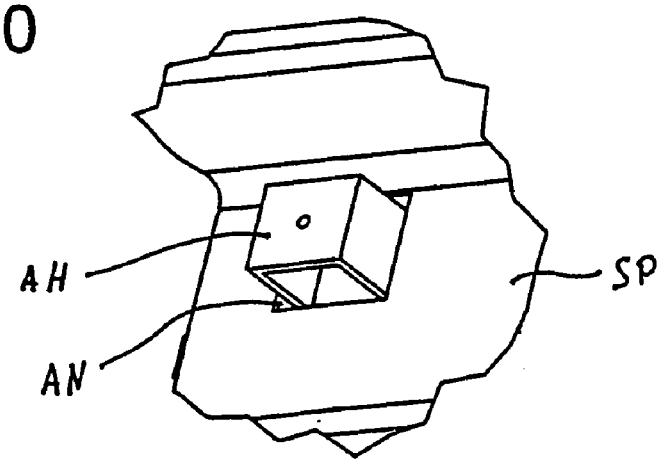

Molding insert and mold frame are releasably coupled by means of a groove/tongue connection, in the drawings according to FIG. 8 to FIG. 10, whereby grooves NE and NF, respectively, are milled into the vertical surfaces of molding insert and mold frame, respectively, that face one another, and a tongue EF, preferably made of metal or of an elastic material, is set in.

Figure 11:
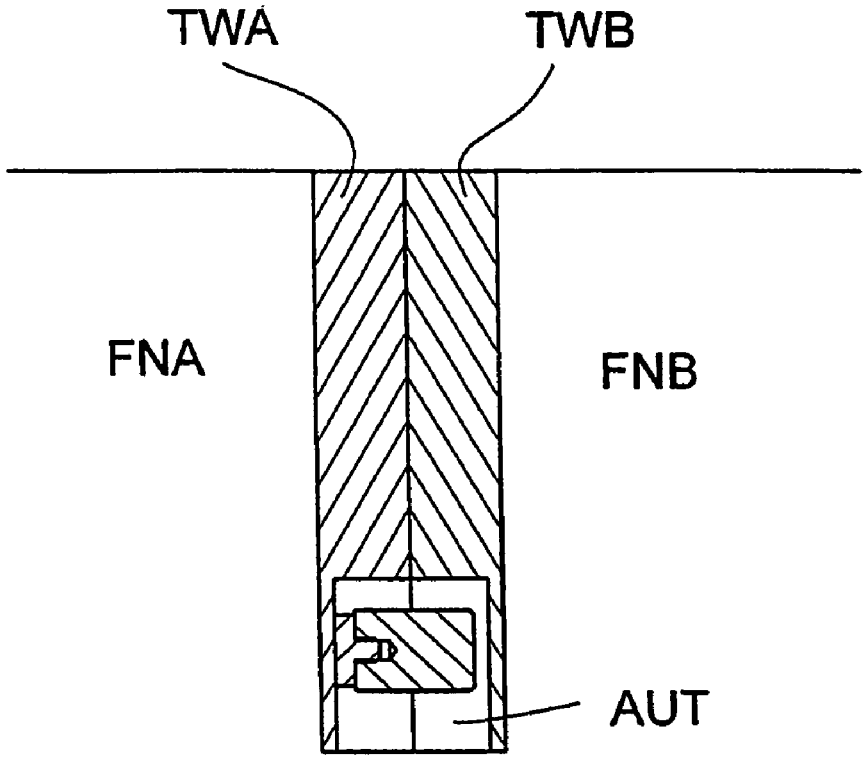
Figure 12:
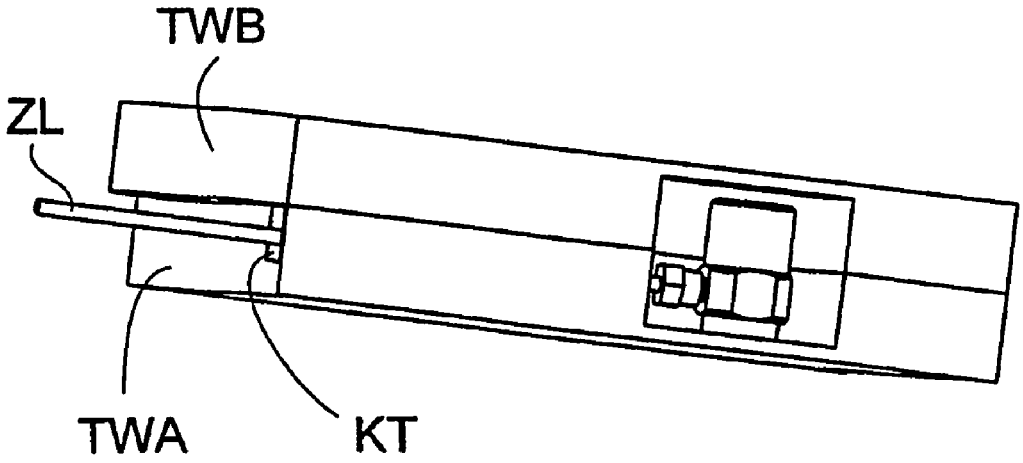

FIG. 11 shows an embodiment for affixing a sensor element between adjacent mold cavities FNA, FNB. The partition between the two mold cavities is structured in two shells here, with partial walls TWA, TWB, which predominantly lie close against one another, but have a recess AUT in an accommodation region, in which a sensor element can be inserted and attached. The attachment can take place, for example, according to one of the methods described, particularly using a glue connection. An electrical supply line ZL to the sensor element SE can advantageously be guided, for example, through a cable channel KT that is structured as a groove in one of the two partial walls. The recess AUT can be open towards the bottom, whereby then, a one-piece partition can also be provided instead of the partial walls TWA, TWB, but is preferably closed on all sides, as protection against contamination.

Figure 13:
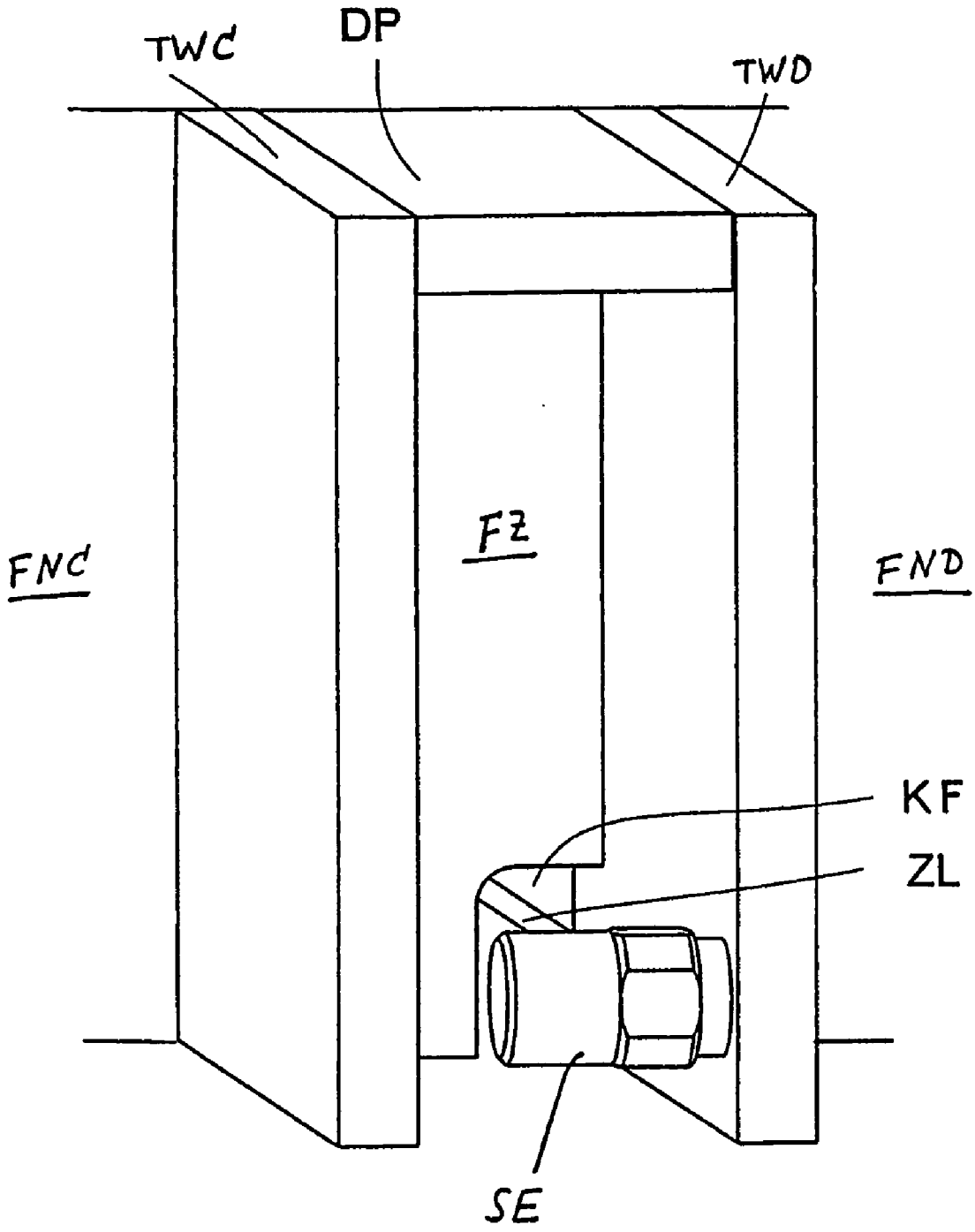

A sensor accommodation between adjacent mold cavities can also be advantageously configured in such a manner that the cross-sections of the mold cavities do not complement one another to form a continuous surface except for partitions, and that a cavity FZ is formed in surface segments having delimitation walls of adjacent mold cavities that are spaced horizontally farther apart, as in FIG. 13, in a detail of two adjacent mold cavities FNC, FND and delimitation walls TWC, TWD, in which cavity a sensor element SE can be disposed. The cavity FZ is protected against the penetration of concrete mass from above, by means of a cover DP. It is advantageous if cable guide devices KF, e.g. in the form of holes through a wall, recesses, bores, grooves, etc., are provided to guide a supply line ZL between sensor element and an evaluation device, not shown.

Cable guides or cable holders for the connecting cables to the sensor elements can advantageously be provided on the mold frame, in order to protect them against damage by means of defined guidance. Also, sensors can be provided on the mold frame, preferably at positions corresponding to FIG. 1, thereby making it possible to conduct difference measurements between the movements of mold frame and molding insert, in the case of a molding insert elastically mounted in the mold frame.

The characteristics indicated above and in the claims as well as evident from the drawings can advantageously be implemented both individually and in various combinations. The invention is not limited to the exemplary embodiments described, but rather can be modified in many ways, within the scope of the abilities of a person skilled in the art.

The invention claimed is:

1. Device for producing concrete molded blocks, having a molding insert comprising one or more mold cavities and having a mold frame, in order to hold the molding insert in a molding machine, particularly during a vibration process, comprising at least one accommodation for connecting a sensor with the molding insert, for local determination of a movement variable of the molding insert.

2. Device according to claim 1, wherein the accommodation includes a recess between two surfaces of molding insert and mold frame that face one another.

3. Device according to claim 2, wherein the recess is delimited on at least four sides by surfaces of the mold frame and the molding insert.

4. Device according to claim 2, wherein the recess has an expanse of at least 10 mm in all directions.

5. Device according to claim 2, wherein the recess is open towards the side and/or towards the bottom.

6. Device according to claim 1, wherein the accommodation is offset from an edge-position mold cavity of the molding insert towards its edge.

7. Device according to claim 1, that wherein a recess is made in the outside wall of the molding insert for the accommodation.

8. Device according to claim 1, wherein the accommodation contains a projection that faces the mold frame, on an outside wall of the molding insert.

9. Device according to claim 8, wherein the projection is configured as a material-homogeneous continuation of the molding insert.

10. Device according to claim 8, wherein the continuation is set onto the molding insert, particularly welded on.

11. Device according to claim 8, wherein the projection projects into a depression of the mold frame.

12. Device according to claim 8, wherein the mold frame has a hole through a wall in the position of the projection.

13. Device according to claim 1, wherein the accommodation is removed by maximally 100 mm, particularly maximally 50 mm, from a corner of the molding insert, along an outside edge of the molding insert.

14. Device according to claim 1, wherein the accommodation is disposed at a distance from the edge of the molding insert, between two adjacent mold cavities.

15. Device according to claim 14, wherein a guide channel leads from the accommodation to a side surface of the molding insert.

16. Device according to claim 1, wherein the molding insert is structured in one piece.

17. Device according to claim 1, wherein the molding insert is structured with material homogeneity.

18. Device according to claim 1, wherein at least part of the walls of the molding insert are structured to be double-shelled.

19. Device according to claim 1, wherein a guide channel that leads to the accommodation is configured in the mold frame.

20. Device according to claim 1, wherein the accommodation has a threaded bore.

21. Device according to claim 1, wherein the accommodation has a threaded pin.

22. Device according to claim 1, wherein damping means, particularly rubber-elastic material, is/are inserted between molding insert and mold frame.

23. Device according to claim 1, wherein four accommodations are provided along the circumference of the molding insert.

24. Device according to claim 1, wherein an accommodation is provided approximately in the center of the surface of the molding insert.

25. Arrangement having a device according to claim 1, and a sensor connected with the molding insert by means of the accommodation.

26. Arrangement according to claim 25, wherein the sensor is releasably connected with the molding insert, in destruction-free manner, in the accommodation.

27. Arrangement according to claim 26, wherein the molding insert is held in the mold frame, movable to a slight extent relative to the latter, during the vibration process.

28. Arrangement according to claim 27, wherein at least one additional movement sensor is disposed on the mold frame, and that an evaluation unit determines at least one movement variable of the relative movement between mold frame and molding insert.

* * * * *

UNITED STATES PATENT AND TRADEMARK OFFICE

CERTIFICATE OF CORRECTION

PATENT NO. : 7,293,977 B2
APPLICATION NO. : 10/538996
DATED : November 13, 2007
INVENTOR(S) : Braungardt et al.

It is certified that error appears in the above-identified patent and that said Letters Patent is hereby corrected as shown below:

Column 8, line 4, (Line 1 of Claim 7), delete the word: "that".

Signed and Sealed this

Twenty-fifth Day of March, 2008

JON W. DUDAS
*Director of the United States Patent and Trademark Office*